US005472019A

United States Patent [19]

Shimono

[11] Patent Number: 5,472,019

[45] Date of Patent: Dec. 5, 1995

[54] INTERLACING ARRANGEMENT IN WOVEN SLIDE FASTENER STRINGER

[75] Inventor: Muchiji Shimono, Toyama, Japan

[73] Assignee: YKK Corporation, Tokyo, Japan

[21] Appl. No.: 327,373

[22] Filed: Oct. 21, 1994

[30] Foreign Application Priority Data

Oct. 29, 1993 [JP] Japan ..... 5-271623
Oct. 29, 1993 [JP] Japan ..... 5-271624

[51] Int. Cl.[6] ..... D03D 1/00

[52] U.S. Cl. ..... 139/384 B; 24/392

[58] Field of Search ..... 139/384 B; 24/392, 24/394, 393

[56] References Cited

U.S. PATENT DOCUMENTS

| | | | |
|---|---|---|---|
| 4,210,180 | 7/1980 | Tsubata | 139/384 B |
| 4,215,729 | 8/1980 | Ofusa | 139/384 B |
| 4,254,803 | 3/1981 | Tsubata | 139/384 B |
| 4,383,558 | 5/1983 | Tsubata et al. | 139/384 B |
| 4,467,840 | 8/1984 | Tsubata | 139/384 B |

*Primary Examiner*—Andy Falik
*Attorney, Agent, or Firm*—Hill, Steadman & Simpson

[57] ABSTRACT

A woven slide fastener stringer which includes a row of coiled coupling elements woven into one longitudinal edge portion of a woven stringer tape with a stuffer cord and upper and lower core threads extending longitudinally through a space defined in the coupling elements. Foundation warp threads and a foundation weft thread laid in double picks cooperate with the upper core thread to weave upper legs in the longitudinal tape edge portion. Binding warp threads underlying lower legs and interlaced at appropriate positions with the foundation weft thread, and the lower core thread are interlaced with a binding weft thread laid in double picks to weave the lower legs into the longitudinal tape edge portion. The binding weft thread is thinner than the foundation weft thread and aligned in parallel juxtaposition with the foundation weft thread in a region of the stringer tape excluding the longitudinal tape edge portion. With this arrangement, the coupling elements can be firmly and stably secured to the longitudinal tape edge portion, and the stringer has a desired flexibility.

7 Claims, 12 Drawing Sheets

INTERLACING ARRANGEMENT IN WOVEN SLIDE FASTENER STRINGER

BACKGROUND OF THE INVENTION

1. Field of the Invention

The present invention relates to a woven slide fastener stringer including a row of coiled coupling elements of synthetic resin woven integrally into a stringer tape along a longitudinal edge portion thereof.

2. Description of the Prior Art

One type of woven slide fastener stringer is known in which a row of coiled coupling elements of synthetic resin are woven into a woven stringer tape along one longitudinal edge thereof, two core threads and a stuffer cord are received longitudinally in a space defined through the coiled coupling elements. One of the core threads and one leg of each coupling element is secured by weaving to one longitudinal tape edge. The other leg of the coupling element is firmly secured to the longitudinal tape edge by a binding thread design. The design includes a binding weft thread running between a foundation weft thread located outside the stuffer cord and the other core thread and interlaced with binding warp threads disposed between the foundation weft thread and the stuffer cord. Also the other core thread is not underlaid any other thread (see, U.S. Pat. No. 4,383,558).

In the above-mentioned woven slide fastener stringer having coiled coupling elements, the binding weft thread in the binding thread design has loops each underlying the upper and lower core threads in inter-element spaces, and extending over and across upper leg adjacent to the coupling head and over lower legs. The upper legs are sandwiched between the core thread and the binding weft thread. In making or finishing the woven slide fastener stringer into a slide fastener chain, a group of the coiled coupling elements are cut off and then removed from the binding thread design to form an element-free space portion. The element-free space portion is relatively thin, however, it results that the core threads disposed in the coiled coupling elements adjacent to the upper and lower legs come off and the binding warp threads float from the binding thread design. When the slide fastener stringer is finished into a single slide fastener, the binding warp threads slacken from the tape edge, thus deteriorating the appearance of the slide fastener. In addition, when the slide fastener is closed, the slackened warp threads are likely to be caught between coupling elements, thereby hindering smooth operation of the slide fastener. To avoid this difficulty, the slide fastener stringer may be finished into a slide fastener with a cut portion of the coupling elements left in a space portion. However, due to the presence of the coupling elements, the space portion is relatively thick and undesirable in quality.

SUMMARY OF THE INVENTION

With the foregoing drawbacks of the prior art in view, it is an object of the present invention to provide a woven slide fastener stringer which has a woven stringer tape of a desired flexibility, and also has a covering structure which is capable of firmly securing a row of coiled coupling elements to a woven tape edge while maintaining a desired flexibility to ensure easy bending or flexing of the stringer toward the element-supporting side of the stringer tape. And the covering structure enables that both of an upper and lower core threads can be held stably in position without being loosened even when a group of coupling elements are removed by cutting the coupling heads or the heel portions to form an element-free space.

According to one aspect of the present invention, there is provided a woven slide fastener stringer comprising a row of coiled coupling elements defining a space extending therethrough, each of the coupling elements including a coupling head, a pair of spaced upper and lower legs extending from the coupling head, and heel portions extending respectively from the legs remotely from the coupling head, a stuffer cord extending longitudinally through the space and positioned closer to the heel portions than to the coupling heads, a pair of upper and lower core threads extending longitudinally through the space on the coupling-head side of the stuffer cord and respectively underlying and overlying the upper and lower legs. The woven slide fastener stringer also comprises a woven stringer tape woven with foundation warp threads and a foundation weft thread laid in double picks. Moreover, the fastener includes a longitudinal edge portion, the foundation weft thread cooperating with the foundation warp threads and the upper core thread to weave the upper legs of the coupling elements into the longitudinal edge portion. The woven slide fastener stringer further comprises a plurality of binding warp threads disposed between the stuffer cord and the lower core thread and interlaced at appropriate positions with the foundation weft thread, and a binding weft thread laid in double picks and being interlaced at appropriate positions with the lower core thread and the binding warp threads and passing under the stuffer cord to weave the lower legs into the stringer tape.

In a preferred embodiment of this invention, the foundation weft thread and the binding weft thread are aligned in parallel juxtaposition and extend into a portion of the stringer tape excluding the longitudinal edge portion.

In a further preferred embodiment of the invention, the binding weft thread has a thickness smaller than that of the foundation weft thread, or more specifically, the thickness of the binding weft thread is substantially half the thickness of the foundation weft thread. And the foundation warp threads are heat shrinkable to a greater extent than the binding weft thread and the foundation weft thread.

And moreover, the binding weft thread passes between the heel portion of one coupling element and the stuffer cord and has a first loop interlaced with the lower leg of the one coupling element with the lower core thread disposed therebetween, and a second loop interlaced with the lower core thread or an outermost one of the foundation warp threads in an inter-element space between the one coupling element and an adjacent coupling element, and the binding warp threads underlie the lower legs to cover lowermost surfaces of the lower legs.

In another aspect of the present invention, there is provided a woven slide fastener stringer in which a binding weft thread laid in double picks runs between one of the foundation warp threads disposed on the heel-portion side of the stuffer cord and the lower core thread, and cooperates with the binding warp threads and the lower core thread to weave the lower legs into the stringer tape, so that the upper core thread is held in position against displacement by the foundation weft thread, and the lower core thread being held in position against displacement by the binding weft thread.

And preferably, the foundation weft thread has successive loops arranged longitudinally of the stringer tape and interlaced with the upper core thread to hold the latter in position with more than two the foundation warp threads disposed therebetween, and the binding weft thread has successive loops arranged longitudinally of the stringer tape and interlaced with the lower core thread to hold the latter in position and form a selvage.

And further preferably, the binding warp thread, the binding weft thread and the lower core thread jointly form a covering thread design underlying the legs of the coupling elements, and a group of the coupling elements are complexly removed by cutting from the covering thread design to form an element-free space portion in the longitudinal edge portion.

The woven slide fastener stringers of the present invention are used in a slide fastener of the so-called "concealed" type in which the coupling elements are mounted on the underside of fastener tapes and not exposed to the front side of the slide fastener. However, the slide fastener stringers may be used in slide fasteners of the general type in which the coupling elements are exposed to the front side of the fastener tapes. The woven slide fastener stringer is paired with an identical stringer to form a slide fastener chain which is subsequently processed to form successive element-free space portions at longitudinally spaced intervals. A pair of top end stops and a bottom end stop are attached to the slide fastener chain at opposite ends of each of the element-free space portion. Thereafter, the slide fastener chain is cut or severed at the element-free space portions to successively form slide fasteners of the general, inseparable type. The bottom end stop may be replaced with a separable end stop composed of a separable pin and a box, in which instance there are produced slide fasteners of the separable type. When such a slide fastener is attached as a closure means to a bag, a garment fabric or the like article in which an object is received, it is readily flexible to accommodate the profile of the object and hence substantially free from accidental separation of the slide fastener chain.

The above and other objects, features and advantages of the present invention will become manifest to those versed in the art upon making reference to the following detailed description and the accompanying sheets of drawings in which preferred structural embodiments incorporating the principles of the present invention are shown by way of illustrative example.

DETAILED DESCRIPTION

A woven slide fastener stringer according to a first embodiment of the present invention will be described below with reference to the accompanying drawings.

Figure 1:
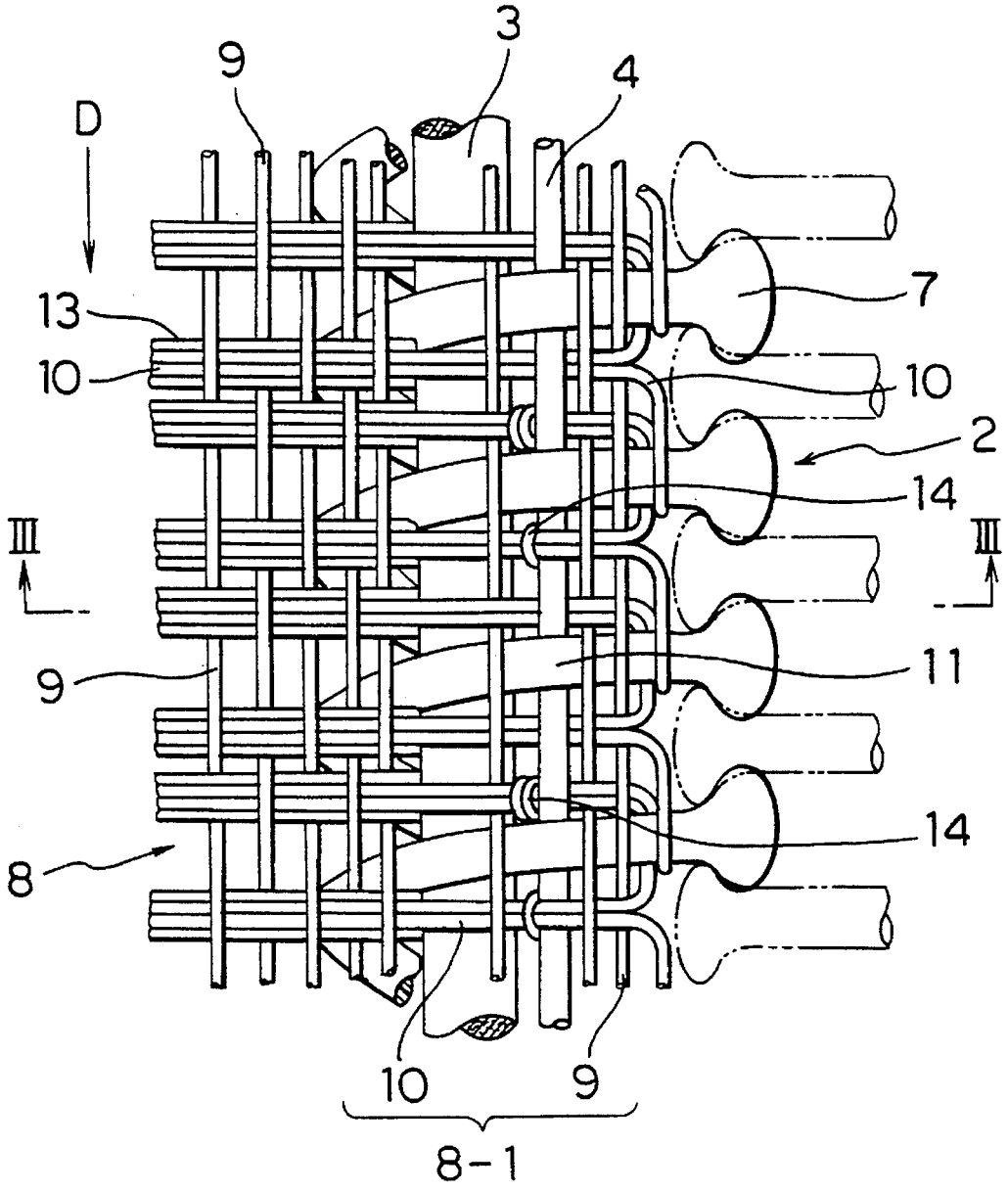
FIG. 1 is an enlarged plan view of a woven slide fastener stringer according to a first embodiment of the present invention.
Figure 2:
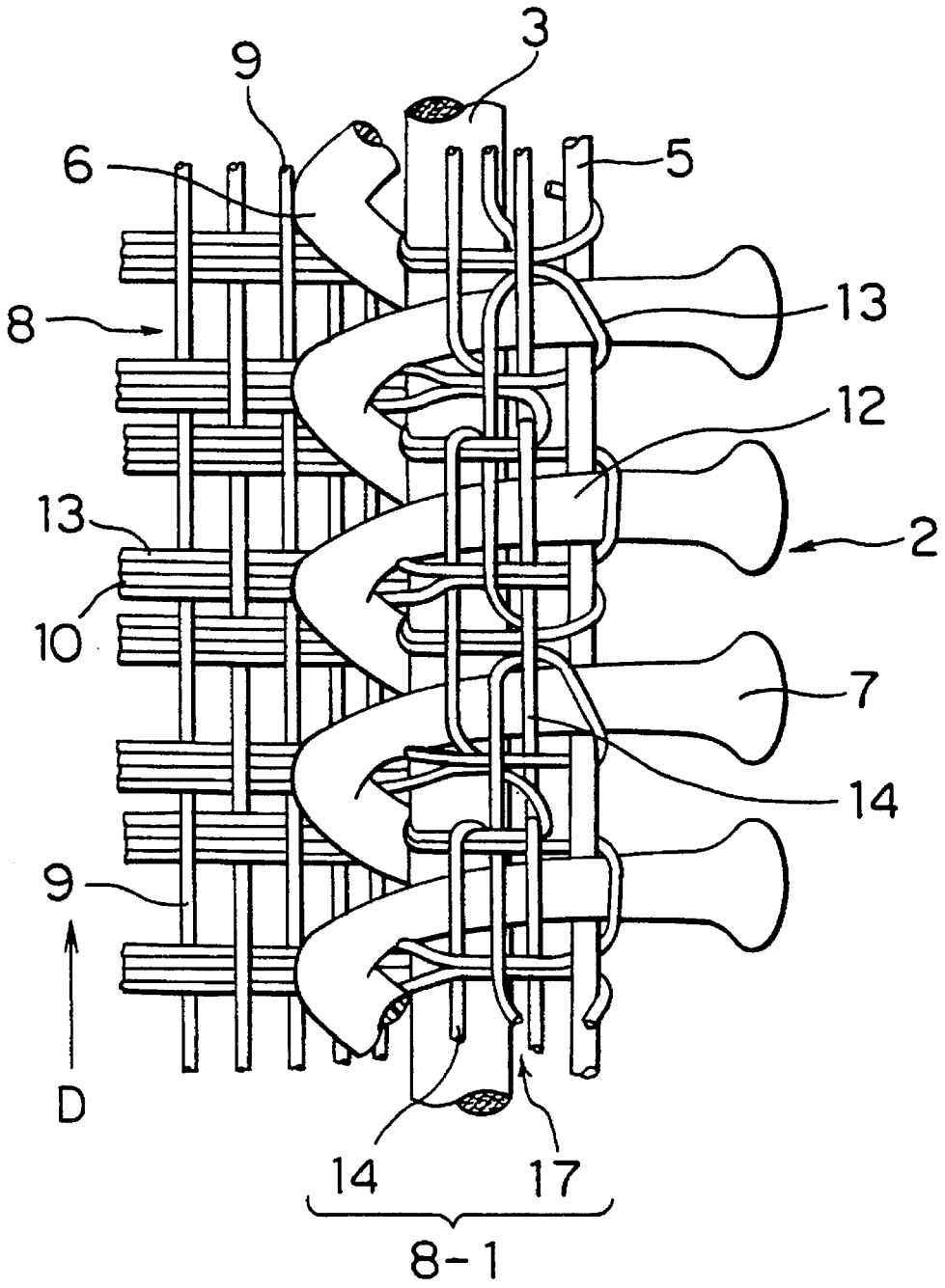
FIG. 2 is a bottom view of FIG. 1.
Figure 3:
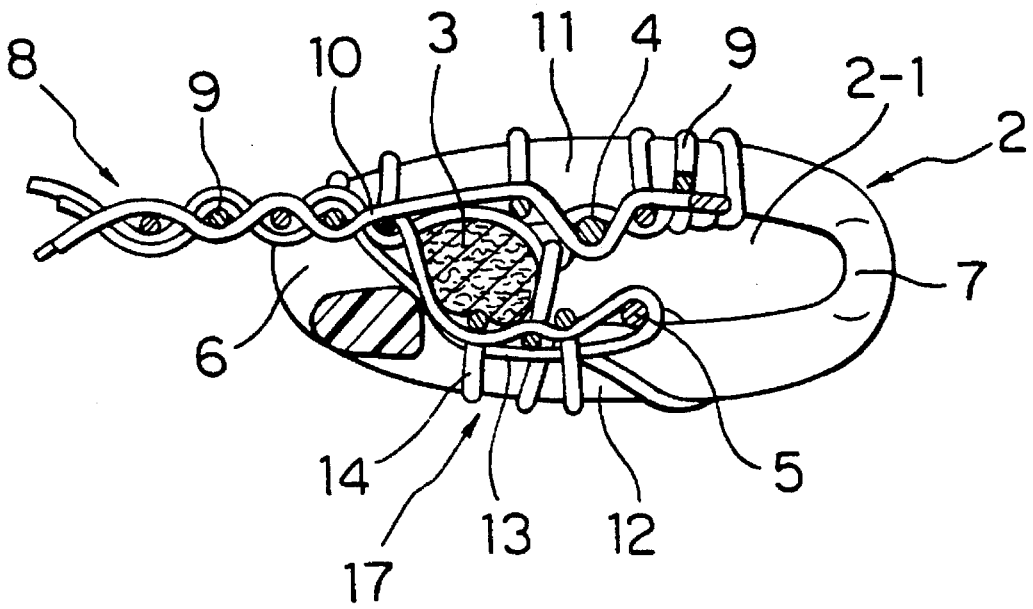
FIG. 3 is a cross-sectional view taken along line III—III of FIG. 1.

The woven slide fastener stringer is of the type which can be manufactured by a well-known apparatus including a needle loom. As shown in FIGS. 1–3, the woven slide fastener stringer includes a row of coiled continuous filamentary coupling elements 2 of synthetic resin woven into one longitudinal edge portion 8-1 of a woven stringer tape 8, with a stuffer cord 3 and a pair of spaced upper and lower core threads 4 and 5 extending longitudinally through a space or tunnel 2-1 defined through the coiled coupling elements 2. Each of the coupling elements 2 includes a coupling head 7 projecting transversely beyond the longitudinal edge portion 8-1 of the stringer tape 8, a pair of upper and lower legs 11 and 12 extending from the coupling head 7, and heel portions 6 extending respectively from the legs 11, 12 remotely from the coupling head 7 and connected to adjacent two of the successive coupling elements 2. The stuffer cord 3 is positioned closer to the heel portions 6 than to the coupling heads 7. The upper core thread 4 underlies the upper legs 11 of the coupling elements 2 and disposed on the coupling-head side of the stuffer cord 3, while the lower core thread 5 overlies the lower legs 12 of the coupling elements 2 and disposed on the coupling-head side of the stuffer cord 3.

The fastener stringer 8 is woven with a number of foundation warp threads 9, a continuous foundation weft thread 10 laid or inserted in double picks and interlaced with the foundation warp threads 9, and a continuous binding weft thread 13 laid or inserted in double picks in a plane defined by the lowermost surfaces of the lower legs 12 of the coupling elements 2 and, on its way to the other longitudinal tape edge portion opposite to the element-supporting longitudinal tape edge portion 8-1, aligned in parallel juxtaposition with the foundation weft thread 10.

The coupling elements 2 are formed from a synthetic resin monofilament having a succession of prospective coupling head portions at longitudinally spaced intervals. The element-forming monofilament is shaped by coiling into a row of coiled coupling elements as they are woven into the stringer tape 8 in synchronism with the weaving of the latter. The upper legs 11 of the coupling elements 2 are woven into the element-supporting longitudinal tape edge 8-1 by gripping them with the stuffer cord 3 and the upper core thread 4 disposed longitudinally in the space 2-1 of the coupling elements 2, the foundation warp threads 9 overlying the upper legs 11, and the foundation weft thread 10 interlaced in double picks with the foundation warp threads 9 and the upper core thread 4. The lower legs 12 of the coupling elements 2 are woven into the element-supporting tape edge 8-1 by gripping them with the stuffer cord 3 and the lower core thread 5 disposed longitudinally in the space 2-1 of the coupling elements 2, a plurality of binding warp threads (three in the illustrated embodiment) 14 underlying the lower legs 12, and the binding weft thread 13 laid in double picks and interlaced with the binding warp thread 14 and the lower core thread 5 to form a covering thread design 17 covering the lowermost surfaces of the lower legs 12 of the coupling elements 2.

The woven slide fastener stringer shown in FIGS. 1–3 is progressively produced in the direction indicated by the arrow D as the weaving proceeds. For better understanding, the woven structure of the slide fastener stringer will be described in greater detail with reference to FIG. 4.

Figure 4:
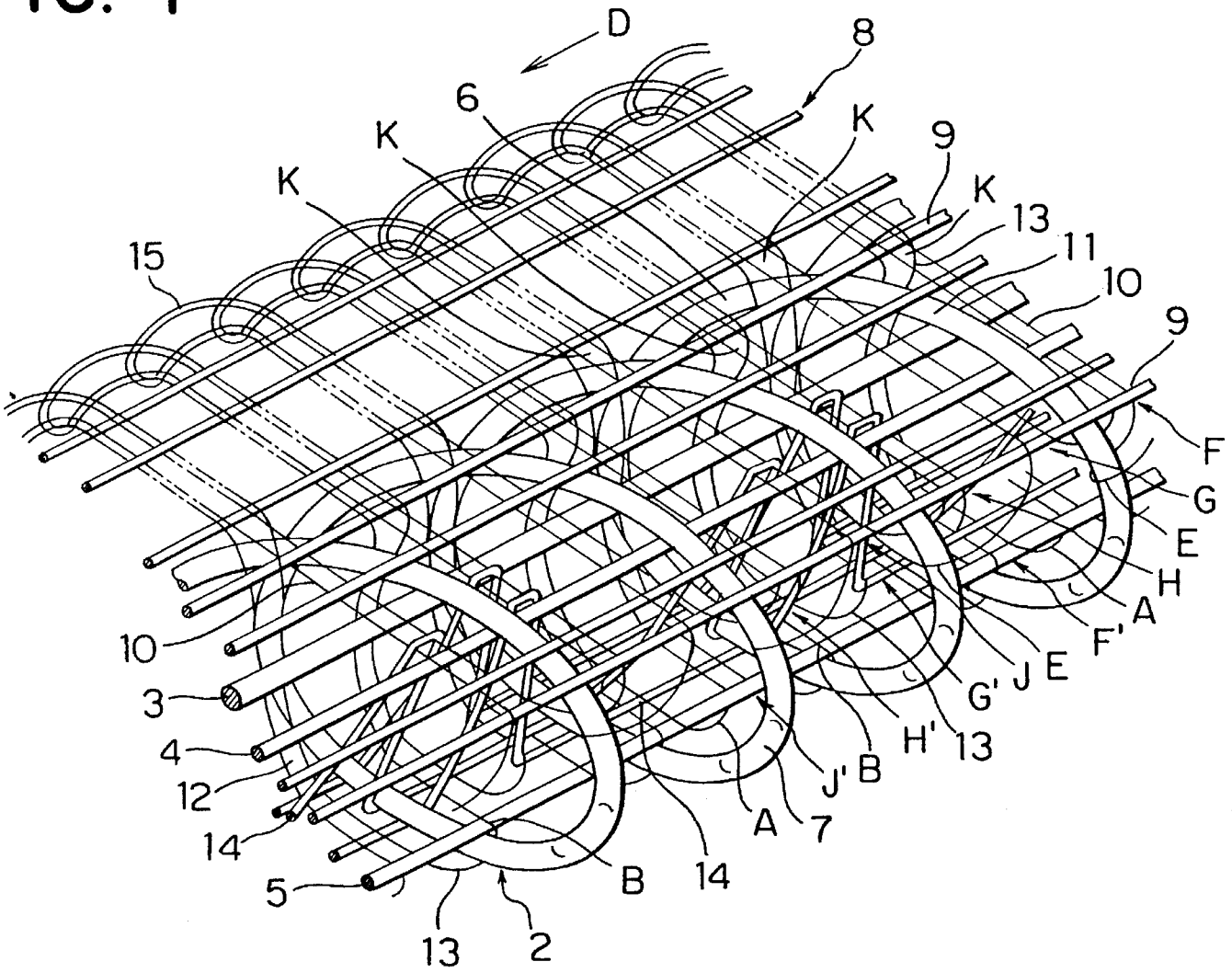
FIG. 4 is an enlarged fragmentary perspective view showing the woven structure of the slide fastener stringer shown in FIGS. 1–3.

As shown in FIG. 4, the foundation weft thread 10 and the binding weft thread 13 are both laid or inserted in double picks. Description given below of the woven structure is first directed to the insertion or picking of the binding weft thread 13 which is achieved to form the covering thread design 17 covering the underside of the row of coupling elements 2. At a point F' in one inter-element space, weft insertion or picking of the binding weft thread 13 in double picks begins from the condition in which the binding weft thread 13 is folded back around the lower core thread 5 from the underside of the latter, thereby forming a loop A. The binding weft thread 13 passes over the lower core thread 5, under a first or outermost binding warp thread 14, again under a second or intermediate binding warp thread 14, and under a third or innermost binding warp thread 14. After that, it passes alternately under and over the stuffer cord 3 and the heel portion 6 of a coupling element 2 to be formed by the next coiling, whereupon the binding weft thread 13 is aligned in parallel juxtaposition with the foundation weft thread 10 as at K.

On the other hand, on weft insertion or picking at a point F, the foundation weft thread 10 inserted in double picks is looped around an element-forming monofilament to be coiled into the coupling element 2. Then, it alternatively underlies and overlies an outermost foundation warp thread 9 and a second outermost foundation warp thread 9, thereafter passes alternately under and over the upper core thread 4 and the stuffer cord 3, and again over a third outermost foundation weft thread 9, whereupon it is aligned in parallel juxtaposition with the binding weft thread 13 as at K. After that, the foundation weft thread 10 and the binding weft thread 13 pass first over the foundation warp thread 9 overlying the heel portion 6 of the coupling element 2, then under an adjacent foundation warp thread 9, and alternatively over and under the successive foundation warp threads 9 in the body of the stringer tape 8, and finally they are knitted by a knitting needle (not shown) with respective loops 15 of the foundation weft thread 10 and the binding weft thread 13 that are formed by the preceding weft insertion or picking. Thereafter, the element-forming monofilament is coiled by one turn to form a new coupling element 2 with the result that one of parallel arranged thread portions of the foundation weft thread 10 laid in double picks is interlaced at a point E with the upper leg 11 of the just coiled coupling element 2. The binding warp threads 14 (three in the illustrated embodiment) extend warp-wise on the underside of the row of coupling elements 2 to cover the lowermost surfaces of the lower legs 12.

In the next weft insertion or picking at a point G', the binding weft thread 13 passes under and across the lower leg 12 of the coupling element 2 just formed as a result of coiling of the monofilament, and thereafter it passes over the lower core thread 5, further over the outermost binding warp thread 14, then alternatively under and over the intermediate and innermost binding warp threads 14, and again under the stuffer cord 3. Subsequently, the binding weft thread 13 passes over the heel portion 6 of a coupling element to be formed by the next coiling where it is aligned in parallel juxtaposition with the foundation weft thread 10 as at K. On the other hand, the next weft insertion or picking of the foundation weft thread 10 at a point G begins from the condition in which a loop of the foundation weft thread 10 underlies the upper leg 11 of the coupling element 2. The foundation weft thread 10 laid in double picks passes alternately over and under the outermost and second outermost foundation warp threads 9. Then, it passes under the upper core thread 4, further over the stuffer cord 3 and under an adjacent foundation warp thread 9, and alternatively over and under the adjacent foundation warp threads 9 where the foundation weft thread 10 is aligned in parallel juxtaposition with the binding weft thread 13 as at K. Thereafter, the foundation weft thread 10 and the binding weft thread 13 are interlaced with successive foundation warp threads 9 in the body of the stringer tape 8, and finally knitted with respective loops of the foundation weft thread 10 and the binding weft thread 13 formed by the preceding weft insertion or picking. Thereafter, the element-forming monofilament is coiled again by one turn to form a new coupling element 2.

In the next following weft insertion or picking at a point H', the binding weft thread 13 laid in double picks passes over the lower core thread 5, then under the outermost warp binding thread 14, subsequently alternatively over and under two adjacent binding warp threads 14, then under the stuffer cord 3, and again over the heel portion 6 of the coupling element 2 where the binding weft thread 13 is aligned in parallel juxtaposition with the foundation weft thread 10 as at K. On the other hand, the foundation weft thread 10 inserted in double picks at a point H is looped around the element-forming monofilament as at E and thereafter passes successively under the outermost foundation warp thread 9, over the second outermost foundation warp thread 9, and alternately under and over the upper core thread 4 and the stuffer cord 3 where it is aligned in parallel juxtaposition with the binding weft thread 13 as at K. Thereafter, the foundation weft thread 10 and the binding weft thread 13 pass alternately over and under the foundation warp thread 9 overlying the heel portion 6 and an adjacent foundation warp thread 9, then are interlaced with the successive foundation warp threads 9, and finally are knitted with respective loops 15 of the foundation weft thread 10 and the binding weft thread 13 formed by the preceding weft insertion or picking. Then, the element-forming monofilament is coiled by one turn to form a new coupling element 2. In this weft insertion or picking at the point H, the foundation weft thread 10 is interlaced with the first or outermost binding warp thread 14 and the third or innermost binding warp thread 14 at positions located between the upper core thread 7 underlying the upper leg 11 and the stuffer cord 3.

In the next weft insertion or picking at a position J', the binding weft thread 13 laid in double picks passes under the lower leg 12 of the coiled coupling element 2 and under the lower core thread 5 with the result that it is looped around the lower core thread 5 as at B. Then, the binding weft thread 13 passes over the outermost binding warp thread 14, under the intermediate binding warp thread 14, again under the innermost binding warp thread 14, then under the stuffer cord 3, and further over the heel portion 6 of a coupling element 2 to be formed in the next coiling, where the binding weft thread 13 is aligned in parallel juxtaposition with the foundation weft thread 10 as at K. On the other hand, the insertion or picking of the foundation weft thread 10 at a point J begins from the condition in which the foundation weft thread 10 has a loop underlying the upper leg 11 of the coupling element 2. The foundation weft thread 10 passes over the outermost foundation warp thread 9, under the second outermost foundation warp thread 9, again over the upper core thread 4, over the stuffer cord 3, under the third outermost foundation warp thread 9, again under the fourth outermost foundation warp thread 9 whereupon the foundation weft thread 10 is aligned in parallel juxtaposition with the binding weft thread 13 as at K. Thereafter, the foundation weft thread 10 and the binding weft thread 13 pass over the foundation warp thread 9 disposed adjacent to the heel portion 6 of the coupling element 2, then are interlaced with the successive foundation warp threads 9 in the body of the stringer tape 8, and finally are knitted with respective loops 15 of the foundation weft thread 10 and the binding weft thread 13 formed by the preceding weft insertion or picking. Then, the element-forming monofilament is coiled by one turn to form a new coupling element. During weft insertion or picking at this point J, the foundation weft thread 10 is interlaced with the intermediate binding warp thread 14 at a position between the upper core thread 4 and the stuffer cord The foregoing weaving patterns or procedures, as a single unit, will be repeated to manufacture a continuous woven slide fastener stringer which includes a row of coiled continuous filamentary coupling elements 2 woven into one longitudinal edge 8-1 of a woven stringer tape 8 as the stringer tape 8 is woven, with lower legs of the coupling elements covered with a plurality of binding warp threads 14 in a covering thread design 17 formed concurrently with the weaving of the stringer tape 8. By virtue of the successive loops A, B formed by the binding weft thread 13, the lower core thread 5 is integrally woven into the covering thread design 17. The binding warp threads 14 are all disposed on the lowermost surfaces of the lower legs 12 of the coupling elements 2 and have undulated portions interlaced with the foundation weft thread 10 extending between the stuffer cord 3 and the upper core thread 4, so that the upper legs 11 and the lower legs 12 of the coupling elements 2 are pulled inwardly toward each other. Thus, the coupling elements 2 are firmly bound or anchored to the element-supporting longitudinal tape edge 8-1. The number of the binding warp threads 14 may be increased depending on the size and shape of the coupling elements 2 to be woven into the stringer tape 8.

In the first embodiment described above, the binding weft thread 13 has a diameter or thickness smaller than that of the foundation weft thread 10, and the foundation warp threads 14 are made of a weaving yarn having a larger heat shrinkability than the binding weft thread 13 and the foundation weft thread 10. For example, the foundation weft thread 10 is composed of a polyester textured yarn of 150 denier; the binding weft thread 13, a polyester textured yarn of 75 denier; the binding warp treads 14, machine sewing yarns of yarn count No. 50; the foundation warp treads 9, polyester textured yarns of 300 denier; the stuffer cord 3, a twisted thread composed of four polyester textured yarns of 450 denier twisted together; and the upper and lower core threads 4, 5, nylon-6 fibers of 420 denier. The respective weaving threads should by no means be limited to these specific kinds. In the drawings the weft thread 10 and the binding weft thread 13 are shown as having the same thickness, however, this is only for a purpose of illustration to facilitate better understanding of the woven structure.

Figure 5:
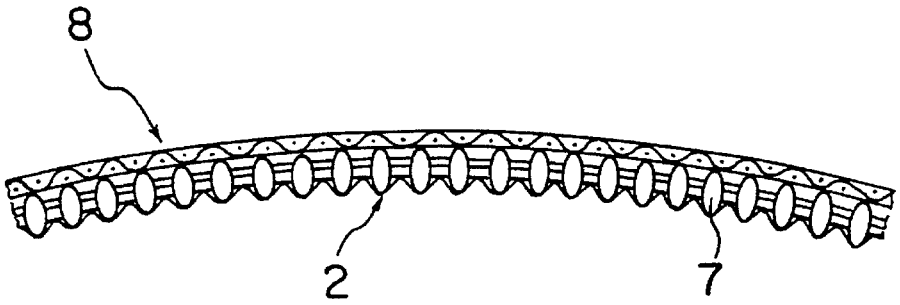
FIG. 5 is a side view, with parts in cross-section, showing the woven slide fastener stringer of FIGS. 1–3 bent toward the element-supporting side.
Figure 6:
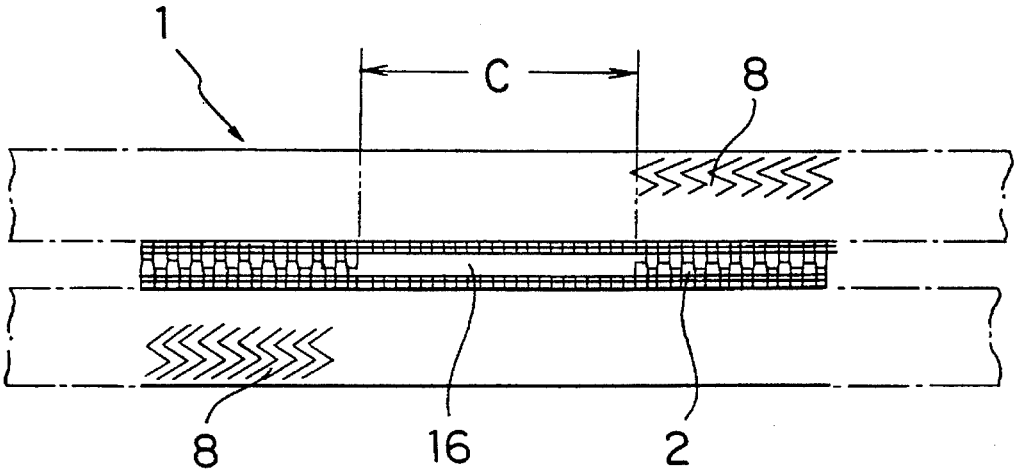
FIG. 6 is a fragmentary plan view of a slide fastener chain including a pair of woven slide fastener stringers shown in FIGS. 1–3.

Since the binding weft thread 13 is thinner than the foundation weft thread 10, the covering thread design 17 underlying the coupling elements 2 is not rendered dense. The woven slide fastener stringer is paired with an identical woven slide fastener stringer to form a slide fastener chain 1, as shown in FIG. 6. Accordingly, the woven slide fastener stringer can be readily bent or flexed toward the element-supporting side, as shown in FIG. 5. When the slide fastener chain 1 is heat-treated, the binding warp threads 14 are heat shrinkable to a greater extent than any other weaving yarns. With this great heat shrinkability of the binding warp threads 14, the above-mentioned flexing tendency of the woven slide fastener stringer is enhanced and the coupling elements 2 can be firmly bound or anchored to the stringer tape 8.

A pair of interengaged rows of coupling elements 2 of the slide fastener chain 1 is partly removed to form an element-free space portion 16 of a distance C. Then, the slide fastener chain 1 is cut or severed at an intermediate portion of the element-free space portion 16 to form a pair of interengaged slide fastener stringers of an individual product length to which a slider, top end stops, and a bottom end stop or a separable end stop are subsequently attached, thus completing a finished slide fastener.

Figure 7:
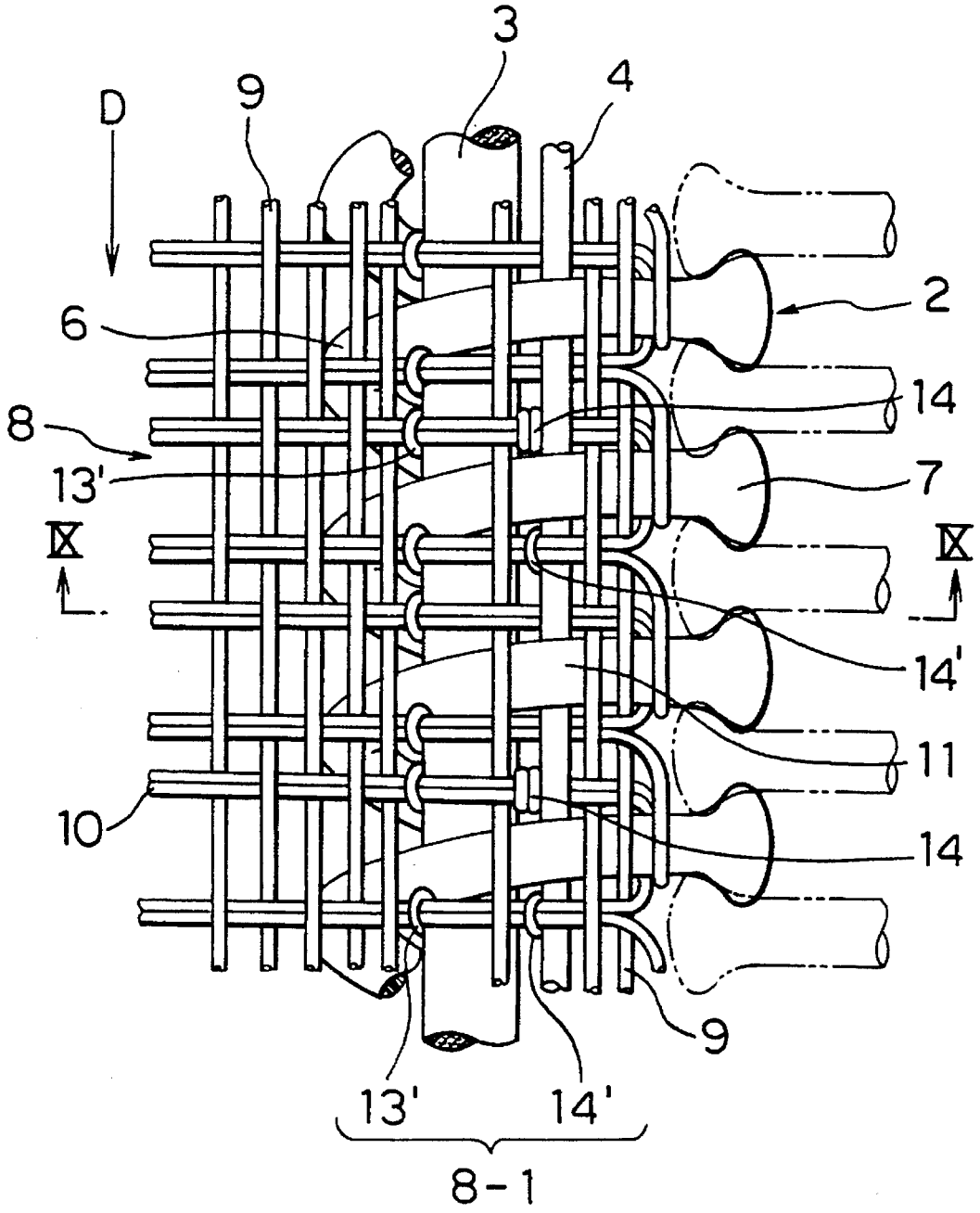
FIG. 7 is an enlarged plan view of a woven slide fastener stringer according to a second embodiment of the present invention.
Figure 8:
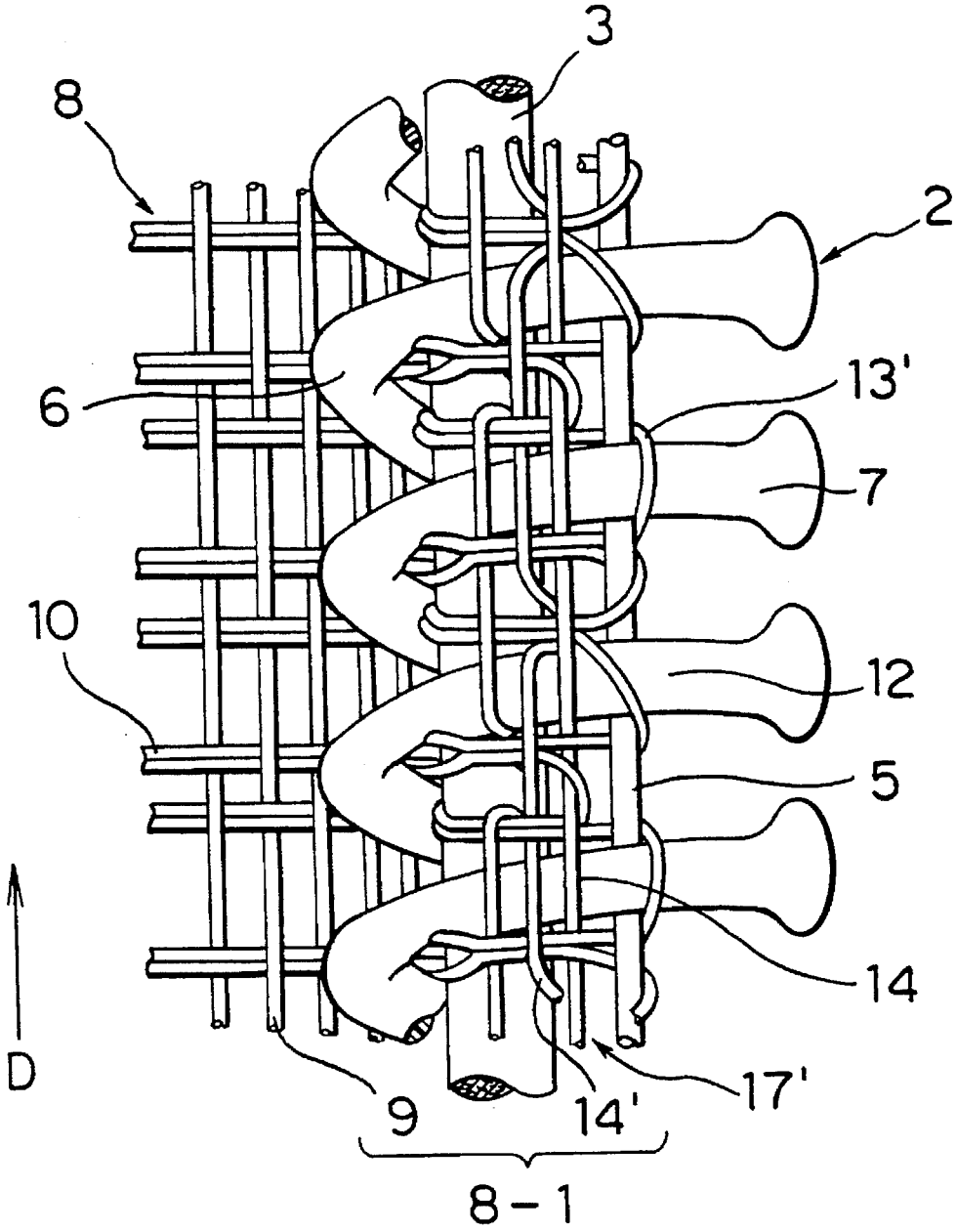
FIG. 8 is a bottom view of FIG. 7.
Figure 9:
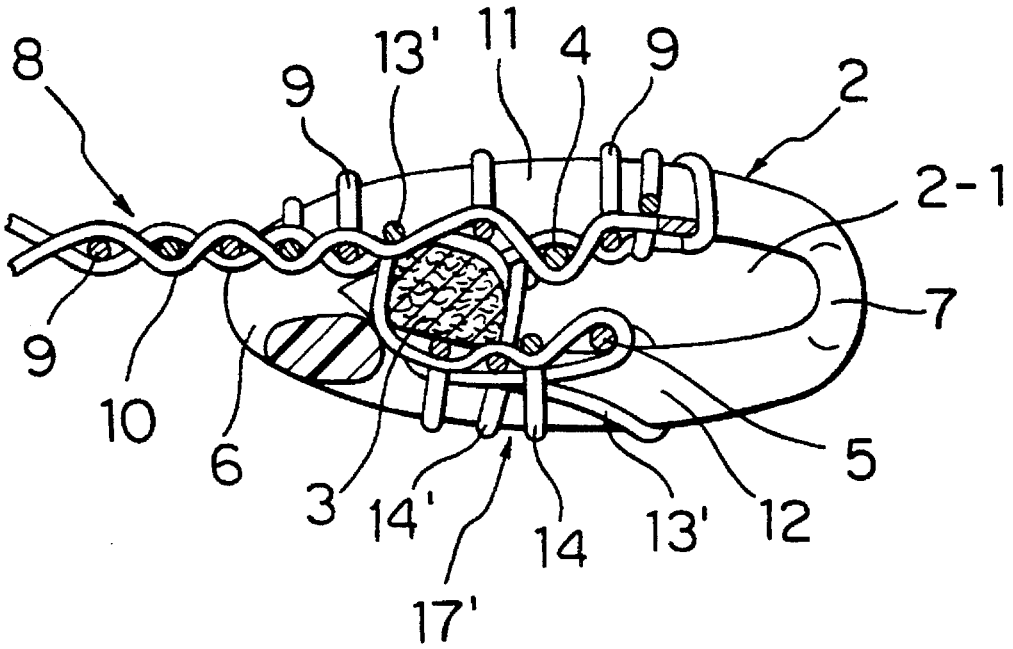
FIG. 9 is a cross-sectional view taken along line IX—IX of FIG. 7.

A second embodiment of this invention will be described below with reference to FIGS. 7 through 16, in which these parts which correspond to those in the first embodiment shown in FIGS. 1–6 are designated by like or corresponding reference characters. A woven slide fastener stringer shown in FIGS. 7 and 8 is progressively produced as the weaving proceeds. For better understanding, description will be given of the woven structure schematically illustrated in FIGS. 10 and 11 which respectively correspond to FIGS. 7 and 8. It is to be noted in FIGS. 10 and 11 the binding warp threads are shown in smaller number than actual, and FIGS. 7, 8 and 9 correspond to FIGS. 1, 2 and 3 of the first embodiment.

Figure 10:
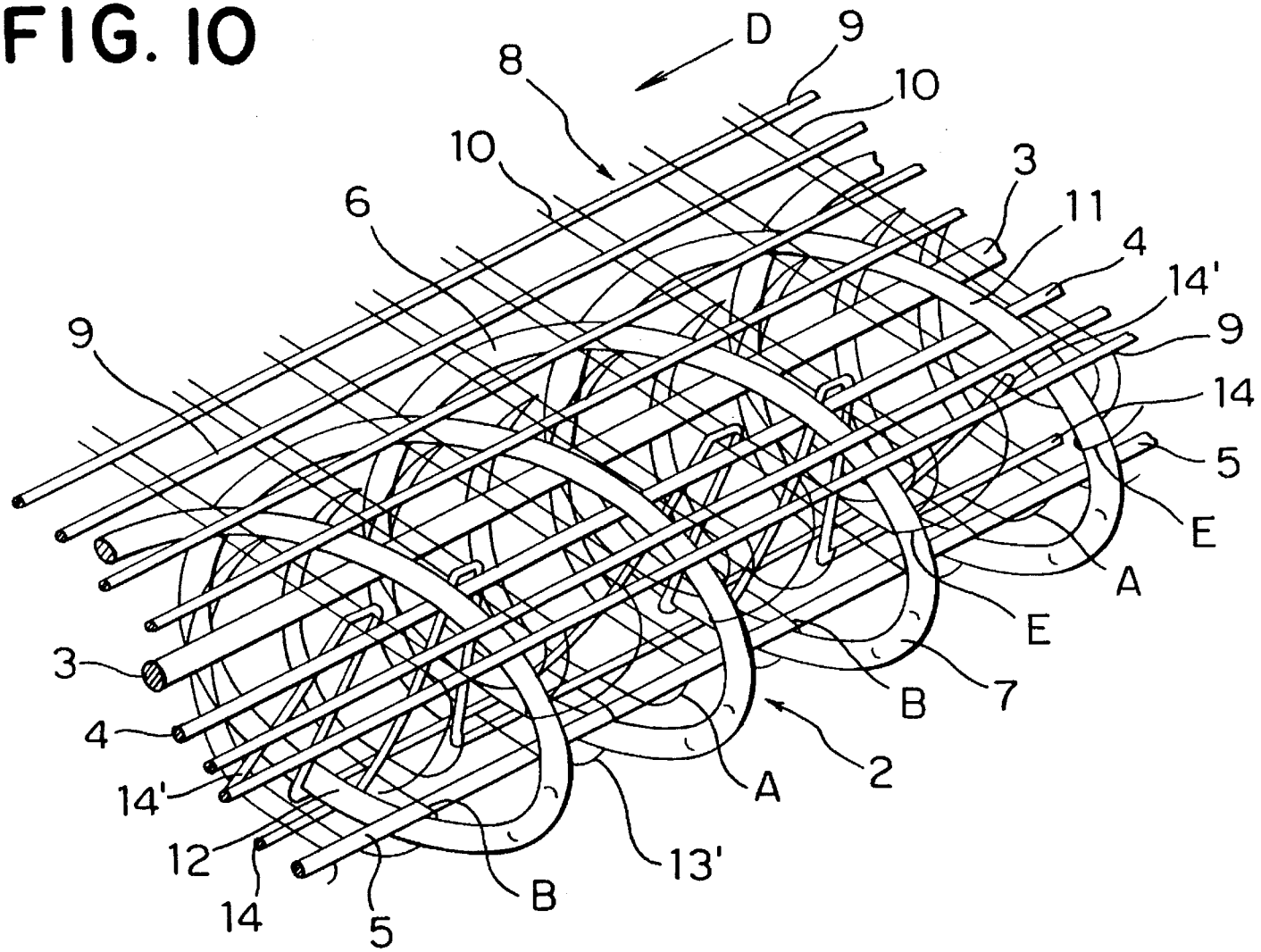
FIG. 10 is an enlarged fragmentary perspective view of FIG. 7, showing the woven structure.

As shown in FIG. 10, a foundation weft thread 10 laid or inserted in double picks first loops around an element-forming monofilament, and subsequently passes alternately over and under an outermost foundation warp thread 9 and a second outermost warp thread 9, then under an upper core thread 4, over a stuffer cord 3, under a third outermost foundation warp thread 9, and over a fourth outermost foundation warp thread 9. After that, it is interlaced with successive foundation warp threads 9 to form a woven stringer tape 8. Then the element-forming monofilament is coiled by one turn to form a new coupling element 2 with the result that one of parallel spaced thread portions of the foundation weft thread 10 laid in double picks is interlaced at a point E with the upper leg 11 of the just coiled coupling element 2. The next weft insertion or picking of the foundation weft thread 10 begins from the condition in which the foundation weft thread 10 has a loop underlying the upper leg 11 of the coupling element 2. Then the foundation weft thread 10 passes under the outermost foundation warp thread 9, over the second outermost foundation warp threads 9, under the upper core thread 4, over the stuffer cord 3, and again over the third outermost warp thread 9, and alternately over and under the fourth and fifth outermost foundation warp threads 9. After that, the foundation weft thread 10 is interlaced with successive foundation warp threads 9 in a body of the woven stringer tape 8.

The next weft insertion or picking of the foundation weft thread 10 starts with the foundation weft thread 10 looped around the element-forming monofilament. The foundation weft thread passes alternately over and under the outermost and second outermost foundation warp threads 9, over the upper core thread 4, over the stuffer cord 3, and under the third outermost foundation warp thread 9, and again under the fourth outermost foundation warp thread 9. Subsequently, it is interlaced with successive foundation warp threads 9, thereby weaving the stringer tape 8. After that, the element-forming monofilament is coiled again in one turn to form a new coupling element 2 with the result that one of two parallel spaced thread portions of the foundation weft thread 10 laid in double picks is interlaced at a point E with the upper leg 11 of the just coiled coupling element 2. In this weft insertion or picking, the foundation weft thread is interlaced with a binding warp thread 14' at a position between the upper core thread 4 and the stuffer cord 3. The next weft insertion or picking of the foundation weft thread 10 begins from the condition in which the foundation weft thread 10 has a loop underlying the upper leg 11 of the coupling element 2. Then the foundation weft thread 10 passes alternately under the outermost foundation warp thread 9, over the second outermost foundation warp threads 9, under the upper core thread 4, over the stuffer cord 3, again over the third outermost warp thread 9, and alternately over and under the fourth and fifth outermost foundation warp threads 9. Subsequently, the foundation weft thread 10 is interlaced with successive foundation warp threads 9 in a body of the woven stringer tape 8. In this weft insertion or picking, the foundation weft thread 10 is interlaced with a binding warp thread 14 at a position between the upper core thread 4 and the stuffer cord 3.

The foregoing weaving patterns or procedures will be repeated to manufacture a continuous slide fastener stringer including a row of coiled coupling elements 2 woven into one longitudinal edge 8-1 of a woven stringer tape 8. The upper core thread 4 is integrally woven into the stringer tape 8 by the foundation weft thread 10 running over and under the upper core thread 4. Concurrently with the weaving of the stringer tape 8, a covering thread design 17' covering the underside of the coupling elements 2 is woven in a manner described below with reference to FIG. 11 in which the slide fastener stringer is inverted in position relative to one shown in FIG. 10, and the terms "over" and "under" used below in connection with FIG. 11 will refer to the geometrical position which is 180° out of phase of the position of the slide fastener stringer actually illustrated in FIG. 11.

Figure 11:
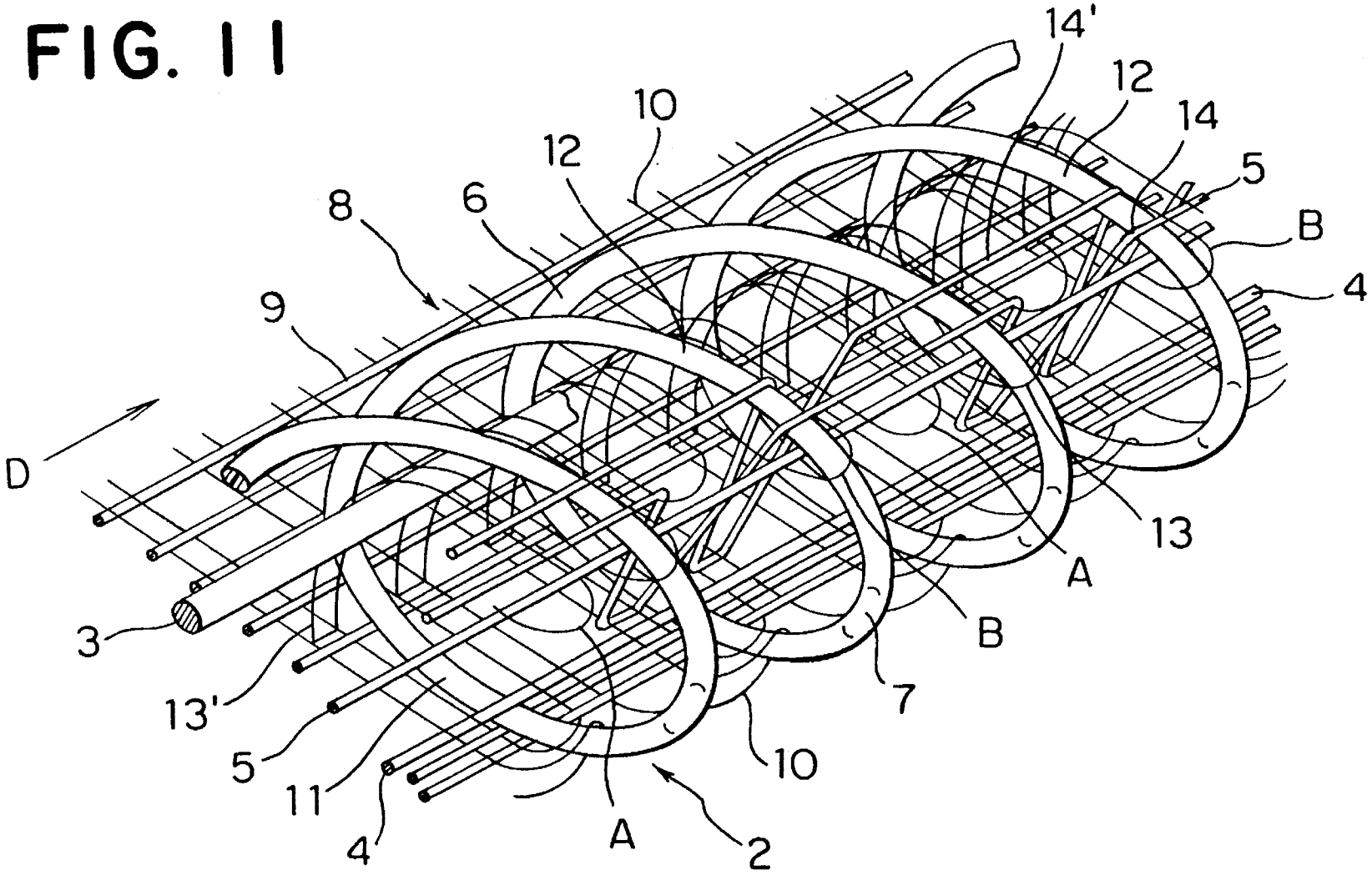
FIG. 11 is an enlarged fragmentary perspective view of FIG. 8, showing the woven structure.
Figure 12:
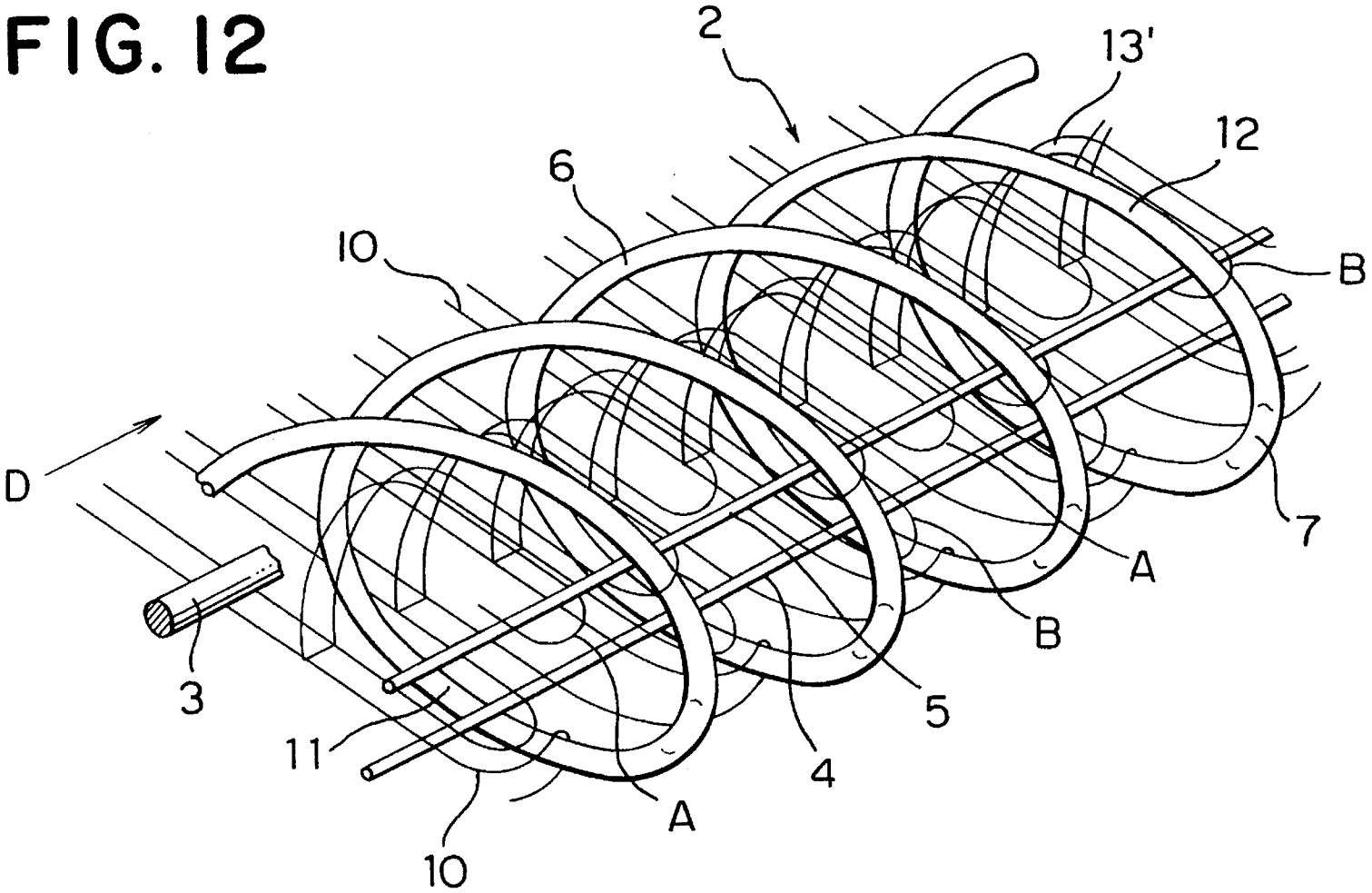
FIG. 12 is a view similar to FIG. 11, but showing the arrangement of a foundation weft thread and a binding weft thread.

As shown in FIG. 11, weft insertion or picking of a binding weft thread 13' in double picks at a position in one inter-element space begins from the condition in which the binding weft thread 13' is folded back around the lower core thread 5 from the underside, thereby forming a loop B. The binding weft thread 13' passes over the lower core thread 5, alternately under and over the binding warp threads 14 and 14', then under an additional binding warp thread, if any, and again under the stuffer cord 3, and loops around the foundation weft thread 10 at a position adjacent to the heel portion 6 which interconnects the upper leg 11 of one coupling element 2 with the lower leg 12 of a next adjacent coupling element 2, thereby forming a woven covering thread design 17'. Thereafter, the element-forming monofilament is coiled to form a lower leg 12. Then, the binding weft thread 13' passes under the lower leg 12 and the next weft insertion or picking is achieved. That is, the binding weft thread 13' laid or inserted in double picks passes successively over the under core thread 5, over the binding warp thread 14, alternately under and over the binding warp thread 14' and an additional binding warp thread, if any, and again under the stuffer cord 3, and finally loops around the foundation weft thread 10 in the same manner as done in the preceding weft insertion. In this weft insertion, the binding warp thread 14 has an undulated portion interlaced with the foundation weft thread 10 laid in on the stringer tape side.

In the next weft insertion or picking, the binding weft thread 13' laid in double picks passes over the lower core thread 5, under the binding warp thread 14, over the binding warp thread 14', again under an additional binding warp thread, if any, and under the stuffer cord 3, and loops around the foundation weft thread 10, thereby forming the woven covering thread design 17'. Then, the element-forming monofilament is coiled to form the lower leg 12 of an adjacent coupling element 2. The binding warp thread 14' is interlaced with the foundation weft thread 10, and at the same time, the binding weft thread 13' passes under and across the lower leg 12 in preparation for a next following weft insertion or picking. Then, the binding weft thread 13' inserted in double picks passes successively under the lower core thread 5, over the binding warp thread 14, again under the binding warp thread 14', over an additional binding warp thread, if any, and under the stuffer cord 3, and subsequently loops around the foundation weft thread 10, thereby forming the woven covering thread design 17'. With this weft insertion or picking, the binding weft thread 13' is concurrently interlaced with the lower leg 12 12 and the lower core thread 5. For better understanding of respective courses of insertion of the foundation weft thread 10 and the binding weft thread 13', reference may be made to FIG. 12.

The foregoing weaving patterns or procedures will be repeated so that a covering thread design 17' covering the underside of the coupling elements is woven in synchronism with the weaving of the stringer tape 8. By virtue of the successive loops A, B of the binding weft thread 13', the lower core thread 5 is integrally woven into the covering thread design 17'. The binding warp threads 14, 14' are all disposed under the lower legs 12 of the coupling elements 2 and have undulated portions interlaced with the foundation weft thread 10 extending between the stuffer cord 3 and the upper core thread 4, so that the upper legs 11 and the lower legs 12 of the coupling elements 2 are pulled inwardly toward each other. Thus, the coupling elements 2 are firmly bound or anchored to the element-supporting longitudinal tape edge 8-1. The number of the binding warp threads 14 may be increased depending on the size and shape of the coupling elements 2 to be woven into the stringer tape 8.

Figure 13:
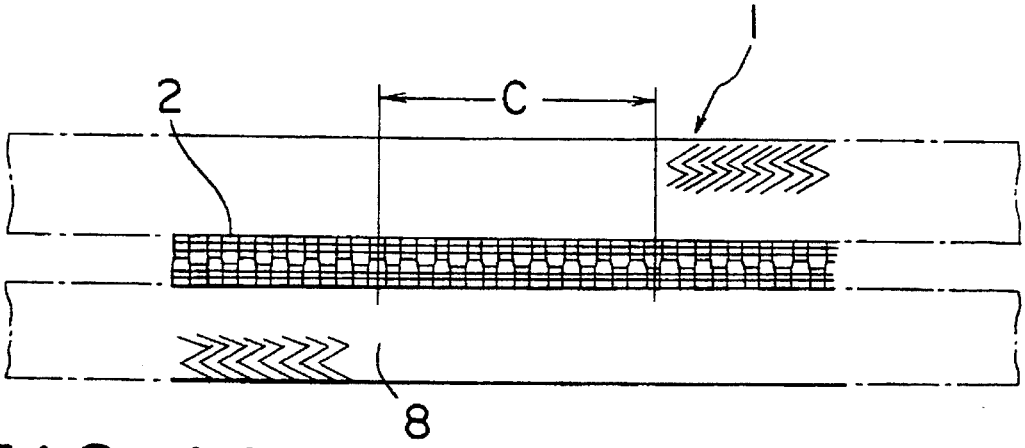
FIG. 13 is fragmentary plan view of a slide fastener chain including a pair of woven slide fastener stringers shown in FIGS. 7–9.
Figure 14:
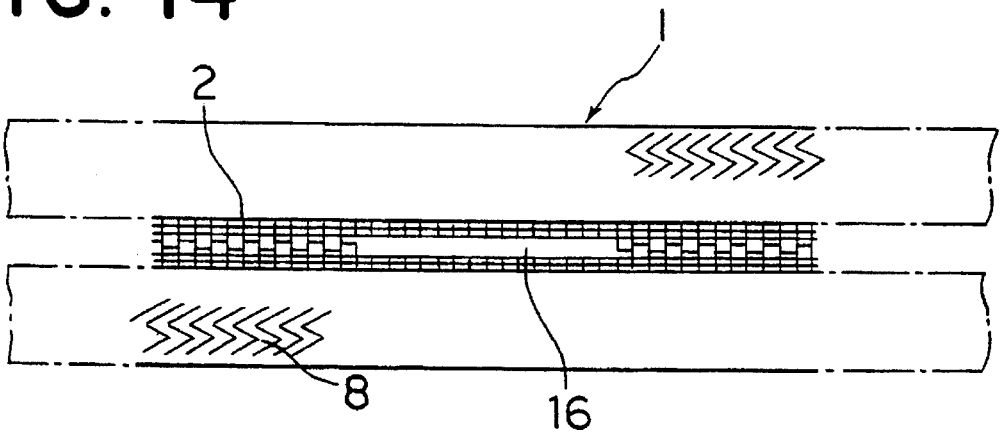
FIG. 14 is a view similar to FIG. 13, showing the slide fastener chain having an element-free space portion.
Figure 15:
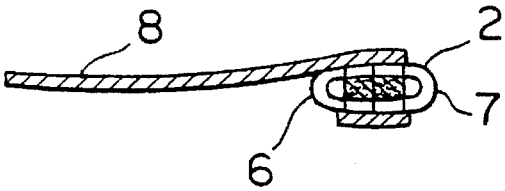
FIG. 15 is a transverse cross-sectional view of the woven slide fastener stringer.

The woven slide fastener stringer is paired with an identical woven slide fastener stringer to form a slide fastener chain 1, as shown in FIG. 13. A pair of interengaged rows of coupling elements 2 of the slide fastener chain 1 is partly removed by a distance C to form an element-free space portion 16, as shown in FIG. 14. Then, the slide fastener chain 1 is cut or severed at an intermediate portion of the element-free space portion 16 to form a pair of interengaged slide fastener stringers of an individual product length to which a slider, top end stops, and a bottom end stop or a separable end stop are subsequently attached, thus completing a finished slide fastener.

Figure 16:
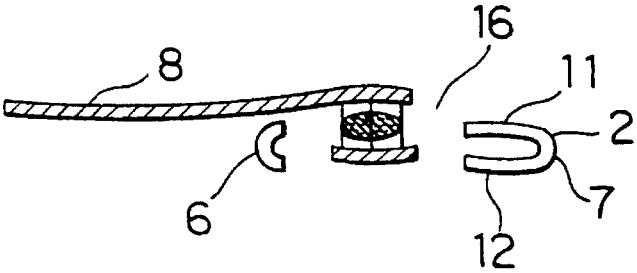
FIG. 16 is a view similar to FIG. 15, showing the manner in which a group of coiled coupling elements are removed.

To form the element-free space portion 16, the row of coupling elements 2 woven into one longitudinal edge of the woven stringer tape 8 are partly cut or severed on their upper and lower legs adjacent to the heel portions 6 and then the coupling heads 7 of the severed coupling elements 2 are pulled out to remove the severed coupling elements 2 from the longitudinal edge portion of the stringer tape 8, as shown in FIG. 16. As an alternative, a group of coupling elements may be cut or severed on their upper and lower legs adjacent to the coupling heads 7, in which instance the heel portions 6 of the thus severed coupling elements 2 are pulled out to remove the severed coupling elements 2 from the longitudinal tape edge, thus forming an element-free space portion 16. In either case, in the element-free space portion 16, the stuffer cord 3, the upper and lower core threads 4, 5, the foundation warp threads 9, and the binding warp threads 14, 14' are all woven integrally into the woven structure of the stringer tape 8 without causing undesired floating or slack.

The woven slide fastener stringers according to the present invention have various advantages, as described below. The woven slide fastener stringer according to the first embodiment shown in FIGS. 1–6 is advantageous in that owing to the woven structure described above, the coupling elements 2 can be fixedly secured to the woven stringer tape 8 along one longitudinal edge 8-1 thereof. At opposite ends of the woven slide fastener stringer, all the weaving threads have stable shapes or profiles so that the coupling elements are stably held in position against raveling from either end, and the element-free space, when formed, is able to hold a desired profile. Further, since the binding weft thread 13 is thinner than the foundation weft thread 10, the slide fastener stringer can be readily bent or flexed toward the element-supporting side. This is particularly beneficial when the slide fastener stringer is used on a bag, a garment fabric or the like article in which an object is received, because the slide fastener stringers can readily flex to accommodate the shape or profile of the object inside, the bag-like article. Thus, accidental separation of the slide faster chain can be avoided. Since the woven stringer tape includes a foundation weft thread 10 and a binding weft thread 13 having a thickness different from that of the foundation weft thread 10, since they extend into a body of the stringer tape in parallel juxtaposed relation, it is possible to secure the coupling elements 2 to the stringer tape 8 with extreme stability. Further, the stringer tape is not rendered very thick and hence has a desired flexibility.

The binding weft thread 13 passes between the heel portion 6 of one coupling element 2 and the stuffer cord 3, and at one end, loops around the lower leg 12 of the coupling element 2 via the lower core thread 5. Between two adjacent coupling elements 2, the binding weft thread 13 loops around the lower core thread 5 or an outermost binding warp thread 14. In addition, the lowermost surfaces of the lower legs 12 of the coupling elements 2 are covered with a plurality of binding warp threads 14. The heel portions 6 of the coupling elements 2 are fully exposed from the under surface of the stringer tape 8 and hence able to guide a slider with high stability and smoothness. Slidability of the slider can be further improved by the binding warp threads 14 running longitudinally and covering the outer surfaces of the lower legs 12 of the coupling elements 2.

Furthermore, since the binding weft thread 13 has a thickness substantially half the thickness of the foundation weft thread 10, the aforesaid woven slide fastener stringer's liability to flexing can be reserved, With the use of the binding warp threads 14 which are composed of yarns having a larger heat shrinkability than yarns of the binding weft thread 13 and the foundation weft thread 10, the coupling elements 2 can be firmly secured to the stringer tape 8. In the element-free space portion 15, the woven structure is rendered tight in the direction of the thickness of the stringer tape 8, thereby preventing the longitudinal tape edge portion from slacking downwardly and improving the appearance of the woven slide fastener stringer.

The woven slide fastener stringer according to the second embodiment shown in FIGS. 7–16 is advantageous in that due to the woven structure described above, the coupling elements 2 can be firmly secured to one longitudinal edge 8-1 of the stringer tape 8, and all the threads have stable shapes or profiles at the ends of the slide fastener stringer, which profiles are able to prevent the coupling elements 2 from raveling from either end; and even when a group of coupling elements 2 are cut or severed at a position adjacent to heads 6 or the coupling heads 7 to form an element-free space portion 15, the slide fastener stringer is able keep a desired shape and configuration without causing raveling at ends of the element-free space portion.

The foundation weft thread 10 loops the upper core thread 4 via a plurality of foundation warp threads 9 to form a selvage of the stringer tape 8, and the binding weft thread 13' loops the lower core thread 5 to form a selvage of the covering thread design 17', so that the upper and lower core threads 4, 5 can be firmly held in position against displacement. Accordingly, when a group of coupling elements 2 are cut and removed to form an element-free space portion 16, open end edges of the element-free space portion 16 are liable to be closed by the foundation warp threads 9 which are readily flexible. Thus the element-free space portion 16 is sightly in appearance.

When two such slide fastener stringers paired to form a slide fastener chain having an element-free space portion 16 is severed at the element-free space portion 15 to form a slide fastener of an individual product length, the core thread 5 is held stably and firmly in position within the space 2-1 in the coupling elements 2 against slack. Thus, the core thread 4 does not get caught in the coupling elements 2 during the use of the slide fastener, so that the slide fastener can be opened and closed smoothly. In addition, the element-free space portion 16 is relatively thin and hence is able to improve the appearance of the slide fastener.

Obviously, various minor changes and modifications of the present invention are possible in the light of the above teaching. It is therefore to be understood that within the scope of the appended claims the invention may be practiced otherwise than as specifically described.

What is claimed is:

1. A woven slide fastener stringer comprising:

a row of coiled coupling elements defining a space extending therethrough, each of said coupling elements including a coupling head, a pair of spaced upper and lower legs extending from said coupling head, and heel portions extending respectively from said legs remotely from said coupling head;

a stuffer cord extending longitudinally through said space and positioned closer to said heel portions than to said coupling heads;

a pair of upper and lower core threads extending longitudinally through said space on the coupling-head side of said stuffer cord and respectively underlying and overlying said upper and lower legs;

a woven stringer tape woven with foundation warp threads and a foundation weft thread laid in double picks, and including a longitudinal edge portion, said foundation weft thread cooperating with said foundation warp threads and said upper core thread to weave said upper legs of said coupling elements into said longitudinal edge portion;

a plurality of binding warp threads disposed between said stuffer cord and said lower core thread and interlaced with said foundation weft thread; and a binding weft thread laid in double picks and being interlaced with said lower core thread and said binding warp threads and passing under said stuffer cord to weave said lower legs into said stringer tape, wherein said binding warp threads are interlaced with said foundation weft thread on the coupling-head side of said stuffer cord, wherein said binding weft thread laid in double picks runs between one of said foundation warp threads disposed on the heel-portion side of said stuffer cord and said lower core thread, and said binding weft thread cooperates with said binding warp threads and said lower core thread to weave said lower legs into said stringer tape, and wherein said upper core thread is held in position against displacement by said foundation weft thread, and said lower core thread being held in position against displacement by said binding weft thread.

2. A woven slide fastener stringer according to claim 1, wherein said foundation weft thread and said binding weft thread are aligned in parallel juxtaposition and extend into a portion of said stringer tape excluding said longitudinal edge portion.

3. A woven slide fastener stringer according to claim 2, wherein said binding weft thread has a thickness smaller than that of said foundation weft thread.

4. A woven slide fastener stringer according to claim 4, wherein said thickness of said binding weft thread is substantially half the thickness of said foundation weft thread, and said foundation warp threads are heat shrinkable to a greater extent than said binding weft thread and said foundation weft thread.

5. A woven slide fastener stringer according to claim 2, wherein said binding weft thread passes between said heel portion of one coupling element and said stuffer cord and has a first loop interlaced with said lower leg of said one coupling element with said lower core thread disposed therebetween, and a second loop interlaced with said lower core thread or an outermost one of said foundation warp threads in an inter-element space between said one coupling element and an adjacent coupling element, and said binding warp threads underlie said lower legs to cover lowermost surfaces of said lower legs.

6. A woven slide fastener stringer according to claim 1, wherein said foundation weft thread has successive loops arranged longitudinally of said stringer tape and interlaced with said upper core thread to hold the latter in position with more than two said foundation warp threads disposed therebetween, and said binding weft thread has successive loops arranged longitudinally of said stringer tape and interlaced with said lower core thread to hold the latter in position and form a selvage.

7. A woven slide fastener stringer according to claim 6, wherein said binding warp thread, said binding weft thread and said lower core thread jointly form a covering thread design underlying said legs of said coupling elements, and a group of said coupling elements is removed from said covering thread design to form an element-free space portion in said longitudinal edge portion.

* * * * *

UNITED STATES PATENT AND TRADEMARK OFFICE

CERTIFICATE OF CORRECTION

PATENT NO. : 5,472,019
DATED : December 5, 1995
INVENTOR(S) : Muchiji Shimono

It is certified that error appears in the above-indentified patent and that said Letters Patent is hereby corrected as shown below:

In claim 4, col. 13, line 21, "according to claim 4," should read --according to claim 3,--

Signed and Sealed this

Twenty-first Day of October 1997

*Attest:*

*Attesting Officer*

BRUCE LEHMAN

*Commissioner of Patents and Trademarks*